United States Patent [19]

Brim

[11] Patent Number: 4,834,380

[45] Date of Patent: May 30, 1989

[54] METHOD OF PLAYING A BOWLING GAME

[75] Inventor: Ted E. Brim, Grand Haven, Mich.

[73] Assignee: Brunswick Corporation, Skokie, Ill.

[21] Appl. No.: 118,244

[22] Filed: Nov. 9, 1987

[51] Int. Cl.[4] ..... A63D 3/00

[52] U.S. Cl. ..... 273/37

[58] Field of Search ..... 273/37, 54 C, 54 R, 273/54 D

[56] References Cited

U.S. PATENT DOCUMENTS

| | | | |
|---|---|---|---|
| 3,153,538 | 10/1964 | Rogers | 273/43 D |
| 3,212,780 | 10/1965 | Jewell | 273/54 C |
| 3,529,824 | 9/1970 | Walch | 273/54 R |
| 4,597,575 | 7/1986 | Kosof | 273/37 |

FOREIGN PATENT DOCUMENTS

| | | | |
|---|---|---|---|
| 809541 | 4/1969 | Canada | 273/54 C |

OTHER PUBLICATIONS

First Stage Market Test of Brunswick's New Bowling System—Final Report, Apr. 1986.

*Primary Examiner*—Anton O. Oechsle

*Attorney, Agent, or Firm*—Wood, Dalton, Phillips, Mason & Rowe

[57] ABSTRACT

A method of playing a bowling game in which players are allowed a number of balls to knock down all pins in each of a plurality of frames. A plurality of differing pin setups are selected in a random sequence to define the plurality of frames. The number of balls delivered by each player in each frame in order to knock down all the pins in that respective frame are counted. A score is recorded for each player in each frame, the score being inversely proportional to the number of balls delivered. Each player's frame scores are added to determine that player's total score for the game. The player's game scores are compared to determine the winner of the game.

12 Claims, 1 Drawing Sheet

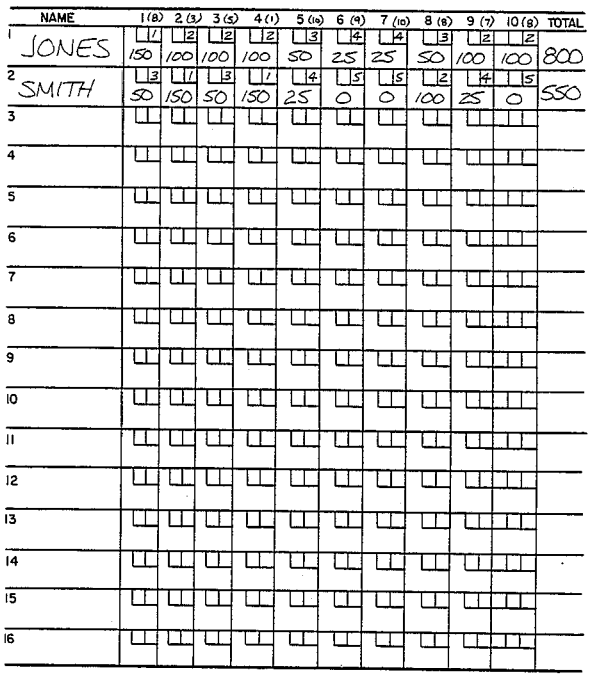

| NAME | 1 (8) | 2 (3) | 3 (5) | 4 (1) | 5 (10) | 6 (9) | 7 (10) | 8 (6) | 9 (7) | 10 (8) | TOTAL |
|---|---|---|---|---|---|---|---|---|---|---|---|
| 1 JONES | 1 150 | 2 100 | 2 100 | 2 100 | 3 50 | 4 25 | 4 25 | 3 50 | 2 100 | 2 100 | 800 |
| 2 SMITH | 3 50 | 1 150 | 3 50 | 1 150 | 4 25 | 5 0 | 5 0 | 2 100 | 4 25 | 5 0 | 550 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

| NAME | 1 (8) | 2 (3) | 3 (5) | 4 (1) | 5 (10) | 6 (9) | 7 (10) | 8 (8) | 9 (7) | 10 (8) | TOTAL |
|---|---|---|---|---|---|---|---|---|---|---|---|
| 1 JONES | 1 150 | 2 100 | 2 100 | 2 100 | 3 50 | 4 25 | 4 25 | 3 50 | 2 100 | 2 100 | 800 |
| 2 SMITH | 3 50 | 1 150 | 3 50 | 1 150 | 4 25 | 5 0 | 5 0 | 2 100 | 4 25 | 5 0 | 550 |
| 3 | | | | | | | | | | | |
| 4 | | | | | | | | | | | |
| 5 | | | | | | | | | | | |
| 6 | | | | | | | | | | | |
| 7 | | | | | | | | | | | |
| 8 | | | | | | | | | | | |
| 9 | | | | | | | | | | | |
| 10 | | | | | | | | | | | |
| 11 | | | | | | | | | | | |
| 12 | | | | | | | | | | | |
| 13 | | | | | | | | | | | |
| 14 | | | | | | | | | | | |
| 15 | | | | | | | | | | | |
| 16 | | | | | | | | | | | |

METHOD OF PLAYING A BOWLING GAME

FIELD OF THE INVENTION

This invention generally relates to the sport of bowling and, particularly, to a method of playing a bowling game.

BACKGROUND OF THE INVENTION

Conventional bowling games are played by a method which depends on the order in which spares and strikes are scored by the players in turn. For many recreational or ordinary players, it is difficult to learn and understand the play of the game. This is because, in part, conventional bowling games require a strike or a spare to add a pin count for pins knocked down in subsequent frames to the pin counts in earlier frames. Quite often, running scores near the end of a game are not entered until the very last ball of a player is delivered. This cumbersome and difficult method of playing a conventional bowling game often leads to frustration and lack of interest to everyone but the skilled player. It is not uncommon for players to simply roll balls at pins and leave the scoring to others and never completely understand the rules of play. This leads to a lack of real interest and ultimately to players giving up on the sport.

In addition, conventional methods of playing bowling games often do not give a true indication of a player's skill. Leads shift back and forth during a game depending solely on sequences of strikes and spares, particularly near the end of a game. One player can build up such an early lead, again depending on his play timing, that other players lose hope and interest, and the level of play is greatly diminished.

There is a definite need for new methods of playing a bowling game which are easier to understand and learn and, accordingly, to play; for games which are more exciting during the entire play of the game; for games which are challenging but not difficult; and for games to increase and enhance the public interest in the sport. This invention is directed to satisfying these needs and to rectifying problems inherent in the conventional method of playing a bowling game. The method of playing the bowling game of this invention also adds an element of chance in setting up the game.

SUMMARY OF THE INVENTION

An object of the invention, therefore, is to provide a new method of playing a bowling game in which players are allowed a number of balls to knock down all pins in each of a plurality of frames.

The method of this invention contemplates selecting a plurality of differing pin setups in a random sequence to define a plurality or series of frames. Each player is required to deliver at least one ball in each of the frames. The number of balls delivered by each player in each of the differing pin setup frames, in order to knock down all of the pins in that respective frame, are counted. A score for each player in each frame is recorded, the score being inversely proportional to the number of balls delivered. Each player's frame scores are added to determine the player's total score for the game. The players' game scores are compared to determine the winner of the game.

It is contemplated that the game can be enhanced by limiting each player to a given maximum number of balls allowed to be delivered in any given frame of the plurality of differing pin setups. With the inverse scoring scheme, the score for any player in any frame where all of the limited number of balls have been delivered may be zero.

Other objects and features of the invention will be apparent from the following detailed description taken in connection with the accompanying drawing.

BRIEF DESCRIPTION OF THE DRAWING

The features of this invention which are believed to be novel are set forth with particularity in the appended claims. The invention, together with its objects and the advantages thereof, may be best understood by reference to the following description taken in conjunction with the accompanying drawing showing a simulated score sheet which might be used in playing the bowling game of this invention.

DETAILED DESCRIPTION OF THE PREFERRED EMBODIMENT

In accordance with the invention, a method for playing a bowling game is provided in which players are allowed a number of balls to knock down all pins in each of a plurality of frames. Specifically, the plurality of frames comprise differing pin setups and include an element of chance in determining the pin setups and the sequence thereof.

More particularly, the method includes the steps of selecting a plurality of differing pin setups in a random sequence to define a series of the plurality of frames. The random sequence can be determined in a manual fashion, such as predesigned index cards or the like, or a computerized system may be employed to randomly select a sequence of differing pin setups.

During play, each player is required to deliver at least one ball in each of the random pin setup sequence of frames. The number of balls are counted as delivered by each player in each frame in order to knock down all the pins in that respective frame.

The scoring involves recording a score for each player in each frame. Preferably, the score is inversely proportional to the number of balls delivered. Each player's frame scores then are added to determine that player's total score for the game. The players' game scores then are compared to determine the winner of the game. With the inverse scoring, the player requiring the fewest number of balls obviously would have the higher numerical score.

The method of playing the bowling game of this invention further can be enhanced by limiting each player to a given maximum number of balls allowed to be delivered in any given frame. Again, with the inverse scoring scheme, the inverse score for any player in any frame where all of the limited maximum number of balls have been delivered, can be zero.

Turning to the single FIGURE of the drawing, a score sheet for a conventional bowling game substantially is illustrated. It can be seen that there are ten frames. It should be understood that the game is not limited to ten frames. Any number of frames can be used. As stated above, the method of this invention includes the step of selecting a plurality of differing pin setups in a random sequence to define a series of the plurality of frames. Although the score sheet is shown with the same random pin setup for each player in each frame, the intent is that the players be required to play individually random pin setups. In other words, the pin setups in any given frame may be different for the different players. The illustration shows the same random pin setup for each player in each frame to simplify the illustration. The differing pin setups would be commensurate to different "leaves" encountered in conventional bowling games. After the random sequence has been arrived at, the number of pins in each of the differing pin setups may be placed in parenthesis behind the number of each frame. For instance, as shown, frame "1" would randomly comprise a pin setup of eight pins. Frame "2" might include a pin setup of three pins. The pin setup for frame "3" might include five pins, as shown, and so on through the ten frames.

Assume a twosome of Jones and Smith are playing a bowling game according to the method of this invention. Each player is required to deliver at least one ball in each of the frames. Jones delivers his first ball in frame "1" and knocks down all eight pins. The number "1" then may be inserted in one of the blocks following Jones' name for frame "1". Smith than takes his turn at frame "1" and requires three balls to knock down all eight pins. The number "3" similarly is inserted in Smith's block under frame "1".

As stated above, the method of this invention contemplates an inverse scoring scheme and may include limiting each player to a given maximum number of balls allowed to be delivered in any given frame. Assume that the maximum number of balls allowed is five balls. An inverse scoring step might include awarding a player 150 points for knocking down all pins with a single ball, 100 points for knocking down all pins with two balls, 50 points for knocking down all pins with three balls, 25 points for knocking down all pins with four balls and zero points if all five balls are required to knock down all of the pins. Of course, this scheme could be changed such that a "zero" score ultimately would be allowed if one of the players has used up all of the given maximum number of balls and still has pins remaining standing.

With the above-described inverse scoring, and referring back to the drawing, since Jones knocked down all eight pins in frame "1" with a single ball, Jones would be awarded 150 points. Since Smith required three balls to knock down all eight pins, Smith would be awarded only 50 points. In frame "2", Jones required two balls to knock down all three pins in that frame and, as shown, therefore was awarded 100 points. Smith knocked down all pins with one ball in frame "2" and, therefore, was awarded 150 points. As a result, the score after two frames was 250 to 200 in favor of Jones. As can be seen from the sample game illustrated in the drawing, the random sequence of differing pin setups just happened to increase dramatically near the end of the game, and including some difficult "leaves". Therefore, the number of balls delivered by Jones and Smith in each frame increased, with a resulting decrease in the inverse scores.

At the end of the game, each player's frame scores are added to determine the player's total score for the game. In the drawing, it can be seen that Jones won with a score of 800 in comparison to Smith's total game score of 550.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A method of playing a bowling game in which players are allowed a number of balls to knock down all pins in each of a plurality of frames, said method comprising:

(a) selecting a plurality of differing pin setups in a random sequence to define said plurality of frames;
(b) requiring each player to deliver at least one ball in each of said frames;
(c) counting the number of balls delivered by each player in each frame in order to knock down all the pins in that respective frame;
(d) recording a score for each player in each frame, the score being inversely proportional to the number of balls delivered;
(e) adding each player's frame scores to determine said player's total score for the game; and
(f) comparing the players' game scores to determine the winner of the game.

2. The method of claim 1 wherein each player is limited to a given maximum number of balls allowed to be delivered in any given frame.

3. The method of claim 2 wherein the inverse score for any player in any frame where all said limited maximum number of balls have been delivered is zero.

4. The method of claim 1 wherein the random pin setup in each frame is different for each player of that frame.

5. The method of claim 1 wherein the random pin setup in each frame is the same for each player.

6. A method of playing a bowling game in which a plurality of differing pin setups are selected in a random sequence to define a plurality of frames and in which players are allowed a number of balls to knock down all pins in each of the frames, said method comprising:

(a) requiring each player to deliver at least one ball in each of said frames;
(b) counting the number of balls delivered by each player in each frame in order to knock down all the pins in that respective frame;
(c) recording a score for each player in each frame, the score being inversely proportional to the number of balls delivered;
(d) adding each player's frame scores to determine said player's total score for the game; and
(e) comparing the players' game scores to determine the winner of the game.

7. The method of claim 6 wherein each player is limited to a given maximum number of balls allowed to be delivered in any given frame.

8. The method of claim 7 wherein the inverse score for any player in any frame where all said limited maximum number of balls have been delivered is zero.

9. The method of claim 6 wherein the random pin setup in each frame is different for each player of that frame.

10. The method of claim 6 wherein the random pin setup in each frame is the same for each player.

11. A method of playing a bowling game in which players are allowed a number of balls to knock down all pins in each of a plurality of frames, said method comprising:

(a) limiting each player to a given maximum number of balls allowed to be delivered in any given frame;
(b) requiring each player to deliver at least one of said maximum number of balls in each of said frames;

(c) counting the number of balls delivered by each player in each frame in order to knock down all the pins in that respective frame;

(d) recording a score for each player in each frame, the score being inversely proportional to the number of balls delivered;

(e) adding each player's frame scores to determine said player's total score for the game; and (f) comparing the players' game scores to determine the winner of the game.

12. The method of claim 11 wherein the inverse score for any player in any frame where all said limited maximum number of balls have been delivered is zero.

* * * * *